US008381520B2

(12) United States Patent
Leroux et al.

(10) Patent No.: US 8,381,520 B2
(45) Date of Patent: Feb. 26, 2013

(54) MOTOR VEHICLE INTERNAL COMBUSTION ENGINE EGR LOOP

(75) Inventors: Samuel Leroux, Poissy (FR); Laurent Albert, Vallangoujard (FR); Sebastien Adenot, Pontoise (FR)

(73) Assignee: Valeo Systemes de Controle Moteur, Cergy Pontoise (FR)

( * ) Notice: Subject to any disclaimer, the term of this patent is extended or adjusted under 35 U.S.C. 154(b) by 318 days.

(21) Appl. No.: 12/811,114

(22) PCT Filed: Dec. 18, 2008

(86) PCT No.: PCT/FR2008/001780

§ 371 (c)(1),
(2), (4) Date: Oct. 11, 2010

(87) PCT Pub. No.: WO2009/106726

PCT Pub. Date: Sep. 3, 2009

(65) Prior Publication Data

US 2011/0048004 A1 Mar. 3, 2011

(30) Foreign Application Priority Data

Jan. 3, 2008 (FR) ..... 08 00026

(51) Int. Cl.
*F02B 33/44* (2006.01)

(52) U.S. Cl. ..... 60/605.2; 60/605.1; 123/568.15; 701/108

(58) Field of Classification Search ..... 60/605.1, 60/605.2; 123/568.15; 701/108
See application file for complete search history.

(56) References Cited

U.S. PATENT DOCUMENTS

| | | | | |
|---|---|---|---|---|
| 5,448,974 | A | 9/1995 | Toda | |
| 7,987,837 | B2 * | 8/2011 | Lupescu et al. | 123/568.2 |
| 2005/0145229 | A1 | 7/2005 | Eriksson et al. | |
| 2005/0193978 | A1 | 9/2005 | Ishikawa | |
| 2005/0241702 | A1 | 11/2005 | Blomquist et al. | |
| 2008/0223038 | A1 | 9/2008 | Lutz et al. | |

FOREIGN PATENT DOCUMENTS

| | | | |
|---|---|---|---|
| DE | 102004044894 | A1 | 3/2006 |
| DE | 102005048911 | A1 | 4/2007 |
| EP | 1103715 | A1 | 5/2001 |
| EP | 1555409 | A1 | 7/2005 |
| FR | 2806448 | A1 | 9/2001 |
| FR | 2879712 | A1 | 6/2006 |
| WO | WO 2007089771 | A2 | 8/2007 |

(Continued)

OTHER PUBLICATIONS

English language abstract for DE102004044894 extracted from espacenet.com database, dated Nov. 2, 2010, 11 pages.

(Continued)

*Primary Examiner* — Ching Chang
(74) *Attorney, Agent, or Firm* — Howard & Howard Attorneys PLLC

(57) ABSTRACT

A motor vehicle internal combustion engine EGR loop, in which:

with the fresh air flow rate in the air inlet path (2) of the EGR valve (1) set at a maximum, the path (3) for the EGR gases in the valve is progressively opened, and before the EGR gas flow rate in the valve increases any further, the fresh air inlet path (2) is progressively closed in order to continue to cause the EGR gas flow rate to increase on an increasing monotonous curve.

8 Claims, 5 Drawing Sheets

FOREIGN PATENT DOCUMENTS

| | | | |
|---|---|---|---|
| WO | WO 2009106725 | A1 | 9/2009 |
| WO | WO 2009106727 | A1 | 9/2009 |

OTHER PUBLICATIONS

English language abstract for DE102005048911 extracted from espacenet.com database, dated Nov. 2, 2010, 13 pages.

English language abstract for FR2806448 extracted from espacenet.com database, dated Nov. 2, 2010, 28 pages.

English language abstract for FR2879712 extracted from espacenet.com database, dated Nov. 2, 2010, 15 pages.

U.S. Appl. No. 12/811,120, filed Jun. 29, 2010, "Motor Vehicle Internal Combustion Engine EGR Loop", 8 pages, English translation for WO 2009/106725.

U.S. Appl. No. 12/811,116, filed Jun. 29, 2010, "Two-Shutter Three-Way Valve", 15 pages, English translation for WO 2009/106727.

PCT International Search Report for PCT/FR2008/001779, dated Jul. 9, 2009, 4 pages.

PCT International Search Report for PCT/FR2008/001780, dated Jul. 13, 2009, 3 pages.

PCT International Search Report for PCT/FR2008/001781, dated Jul. 9, 2009, 4 pages.

* cited by examiner

MOTOR VEHICLE INTERNAL COMBUSTION ENGINE EGR LOOP

RELATED APPLICATIONS

This application claims priority to and all the advantages of International Patent Application No. PCT/FR2008/001780, filed on Dec. 18, 2008, which claims priority to French Patent Application No. FR 08/00026, filed on Jan. 3, 2008.

The invention relates, with reference to the attached FIG. 7, to the EGR loop of a motor vehicle internal combustion engine, comprising the engine 21, a combustion gas exhaust manifold 22, a turbocharger 24, a turbine 25, the exhaust gas recirculation (EGR) loop 28 with a cooler 29 and the low-pressure three-way valve 30 positioned upstream of the turbocharger 24 compressor 26 and connected thereto by its outlet and comprising two inlets for receiving fresh air and the cooled exhaust gases in a mixture the pressure of which is increased in the compressor 26, and an engine intake manifold 23 for receiving the exhaust gases and the air from the compressor.

The purpose of the EGR loop is to reduce the emissions of nitrogen dioxide by reducing the combustion temperature, by slowing the combustion of the oxidant mixture and absorbing some of the energy. The cooler in the EGR loop is there to drop the combustion temperature at high speed (high load).

There are a number of conceivable modes for operating the three-way valve and therefore the engine: the engine can receive only fresh air, without any recirculated exhaust gas. The engine can receive fresh air mixed with some of the exhaust gases, the pressure difference between the exhaust and the inlet side of the turbocharger compressor being enough to recirculate the exhaust gases. When the pressure difference is not high enough to recirculate the exhaust gases and provide the correct EGR ratio, a back pressure can be created by throttling the exhaust path downstream of the EGR loop in order thus to force some of the exhaust gases toward the engine intake path. Because of its complexity, however, this solution is not very satisfactory and the invention of the present application is another solution to the problem of creating a back pressure in order to ensure the correct EGR flow rate.

Thus, the invention relates to a particular mode of using the above EGR loop, characterized in that:

- with the fresh air flow rate in the air inlet path of the EGR valve set at a maximum,
- the path for the EGR gases in the valve is progressively opened, and
- before the EGR gas flow rate in the valve increases any further,
- the fresh air inlet path is progressively closed in order to continue to cause the EGR gas flow rate to increase on an increasing monotonous curve.

For preference, the invention is implemented with a three-way valve that has two flaps for the two paths, fresh air and EGR gas respectively. The phase shift of the closing of the fresh air inlet valve can also be achieved using a single-flap three-way valve involving far narrower angular zones.

In the preferred mode of implementation of the invention, using a three-way valve that has two flaps, with the EGR gas flow rate in the EGR inlet path of the valve beginning to drop after a rotation of the corresponding flap through about 55°, it is in this angular position of the EGR gas flap that the fresh air intake flap begins to be turned in order to close the fresh air inlet path in the EGR valve. The intake flap (5) may be rotated until it has been turned through 90°. This rotation may lead to the air inlet path (2) being completely shut off. As an alternative, the passage is shut off only partially, for example using a flap the diameter of which is smaller than the diameter of the passage.

It will be noted that, in the engine of document US 2005/0193978, the overpressure defined by a determined valve is always at the level corresponding to the operation of the engine; if the overpressure varies as a result of this valve, then the amount of air admitted varies also.

The invention will be better understood from the following description of the mode of use of the three-way valve and therefore of the EGR loop and of the three-way valve itself, with reference to the attached drawing in which:

FIGS. 1*a*, 1*b*, 1*c*, 1*d* illustrate the four modes of use of the three-way valve of the EGR loop, the special use of which is claimed by the present application;

FIGS. 2*a*, 2*b*, 2*c* represent the curves of air flow rate (1*a*), of the natural flow rate of EGR exhaust gases (dgn) and of the flow rate, forced according to the invention, of EGR exhaust gases (dgf), as a function of the angular positions ($\alpha$) of the corresponding flaps;

Figure 1A:
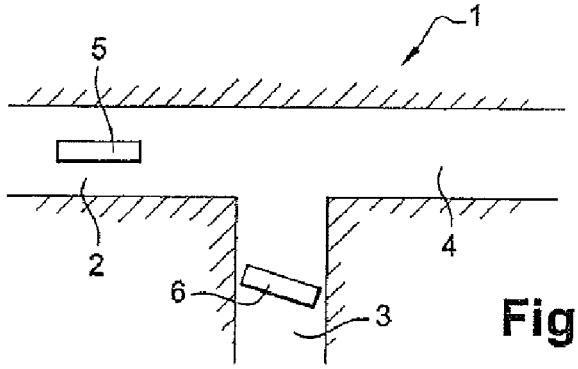
Figure 1B:
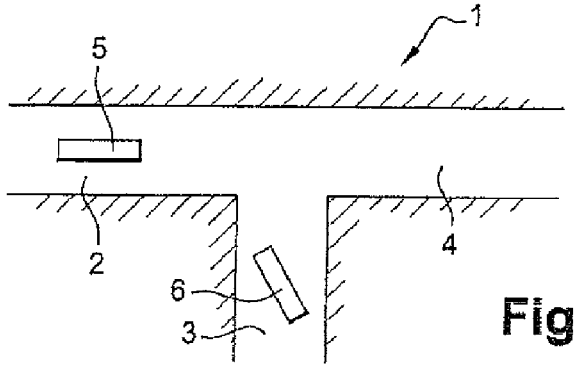
Figure 1C:
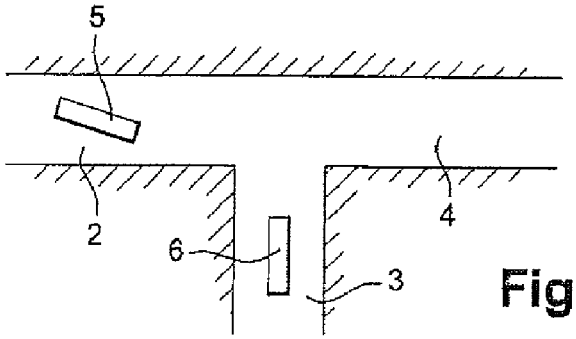
Figure 1D:
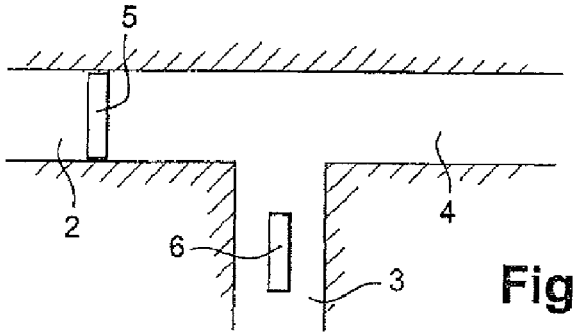

The EGR valve 1 of FIGS. 1*a*, 1*b*, 1*c* schematically comprises an air inlet 2, a recirculated exhaust gas inlet 3 and an air and gas outlet 4.

The valve 1 here is a valve with two flaps, one flap 5 in the air inlet path 2 and one flap 6 in the gas inlet path 3.

First of all, the air flap 5 is in an angular position (0°) that allows a maximum air flow rate through the path 2 and the gas inlet flap 6 is in an angular position(90°) that shuts off the path 3.

Then, without the air flap 5 pivoting, the gas inlet flap 6 begins to pivot in order progressively to open the path 3 to the EGR exhaust gases (FIG. 1*a*). This is region I of the curves 2. Next, with the air flap 5 remaining in he same position in which the air inlet 3 is wide open, the gas flap 6 pivots in order to open the gas path 6 considerably (FIG. 1*b*). This is region II of the curves 2. When the gas flap 6 is in a certain angular position, in this instance 35°, that is to say after it is rotated through 55°, the flow rate of gases in the path 3 increases practically no further and, while continuing to pivot the gas flap 6, the air flap 5 starts to be pivoted in order to close the air inlet path 2, with a corresponding temporal offset, thus forcing the engine to take in more EGR gas (1*c*).

This is the start of region III of the curves 2, the exhaust gas flow rate curve passing through a point of inflexion in order to continue to rise.

This region III continues until the gas flap 6 reaches the angular position O° in which the gas inlet path 3 is wide open and the air flap is in the angular position (90°) in which the air inlet path 2 is completely or partially shut off.

In order to drive the three-way EGR valve in the way defined hereinabove, this three-way valve has the drivetrain that will now be described with reference to FIGS. 3 to 5.

The drivetrain of the three-way valve 1 comprises a gear set here extending between a DC motor 7 and two shafts 51, 61 that turn the air flap 5 and the gas flap 6 respectively. The two shafts 51, 61 run parallel to one another.

Secured to the shaft 14 of the motor 7 is a drive pinion 8 that drives an intermediate gear wheel 9 bearing a peripheral tooth set 10 and a central tooth set 11.

The peripheral tooth set 10 of the intermediate wheel meshes with an annulus gear 12 that drives the rotation of the air flap 5. The annulus gear 12 is free to rotate with respect to the spindle 51 of the flap 5. This flap 5 is rotationally driven by the annulus gear 12 via a driving pin 15 which itself rotates as one with the spindle 51 of the flap 5. This pin 15 when at rest lies against an adjustable end stop 16 secured to the valve body (not depicted). The annulus gear 12 comprises an angular cutout 17 designed to allow the annulus gear 12 to rotate freely over a defined angular sector without driving the pin 15, that is to say the flap 5. It is when the annulus gear 12 is rotated beyond this angular sector, in one direction or the other, that the edge of the cutout 17 then drives the pin 15.

The central tooth set 11 of the intermediate wheel 9 for its part meshes with an annulus gear 13 for driving the rotation of the gas flap 6. The annulus gear 13 rotates as one with the spindle 61 of the flap 6.

The flap 6 is therefore rotationally driven directly by the rotation of the annulus gear 13, while the flap 5 is rotationally driven only when the annulus gear 12 is driving the rotation of the pin 15.

In the example considered, the motor 7, via its pinion 8, driven in the counterclockwise direction, drives the rotation of the intermediate wheel 9 in the clockwise direction. The wheel 9 in turn, via its tooth sets 10, 11, drives the two annulus gears 12, 13 in the counterclockwise direction, these two annulus gears therefore being rotated by the same intermediate wheel 9 but via two different tooth sets 10, 11. The gearing ratio between the shaft 14 of the motor 7 and the gas flap 6 is 15.67 here, the ratio between the shaft 14 and the air flap 5, when the latter is being driven, being 6.67.

The mechanism for phase-shifting the closing of the air flap 5 will now be described.

Figure 3:
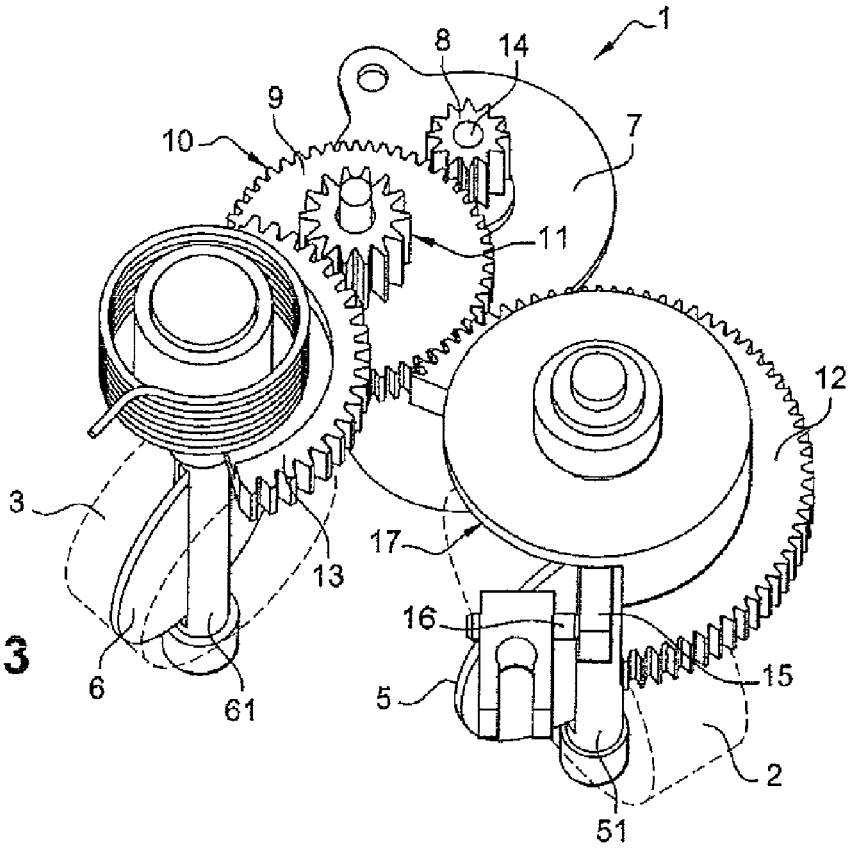
FIG. 3 is a perspective view of the drivetrain of the three-way valve with two flaps, with the air flap open and the gas flap closed.
Figure 4:
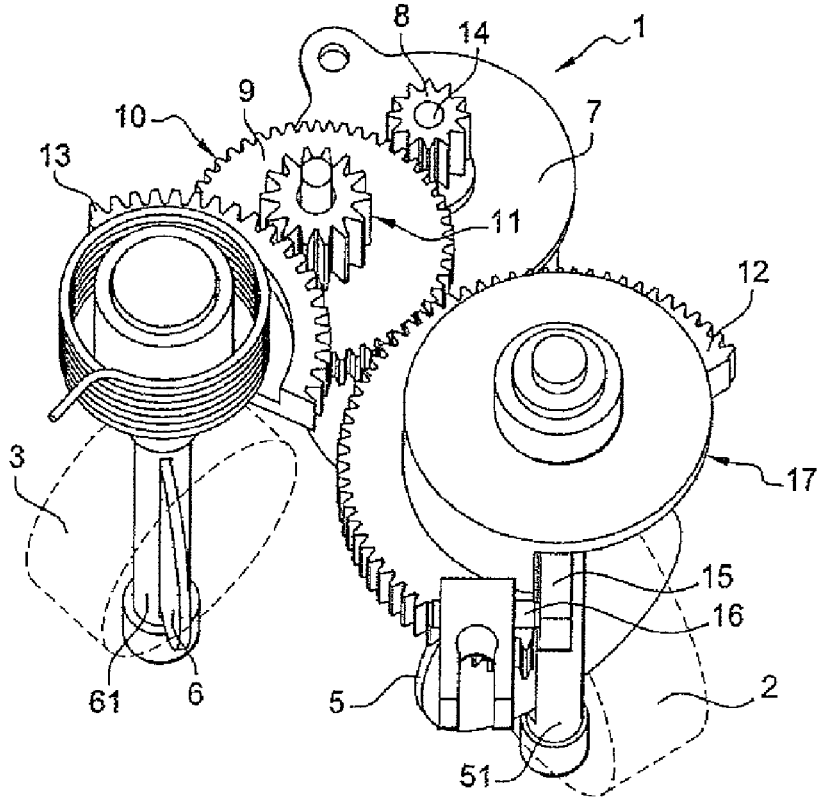
FIG. 4 is a view of the valve of FIG. 3, with the gas flap in a partially open position.
Figure 5:
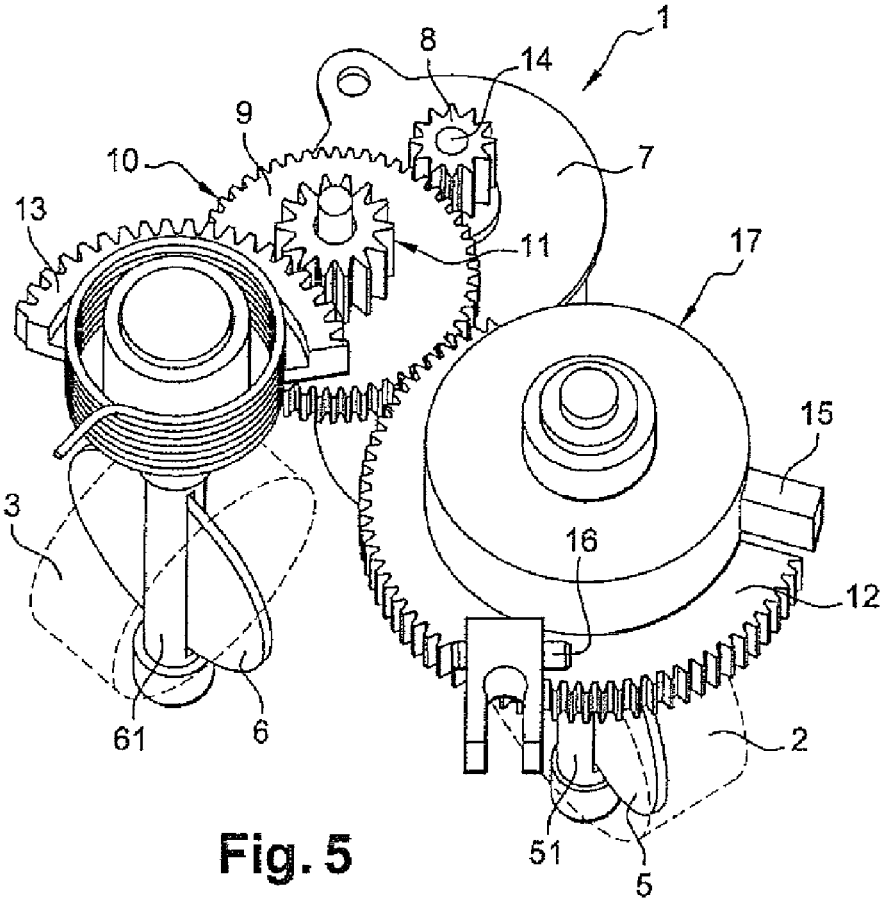
FIG. 5 is a view of the valve of FIG. 3 with the gas flap open and the air flap closed.

FIGS. 3, 4 and 5 show the annulus gears and gearwheels at various stages in the rotation of the pinion 8.

From FIG. 3 to FIG. 4, the annulus gears 12 and 13 are driven in the counterclockwise direction so as causing the flap 6 to open while the flap 5 remains immobile, because of the angular cutout 17. In the position of FIG. 4, one of the edges of this cutout 17 comes into contact with the pin 15.

The annulus gear 12 therefore continues to rotate in the direction of the position depicted in FIG. 5, the pin 15 (and therefore the flap 5) therefore being rotated. The flap 5 therefore closes with a temporal offset permitted by the cutout 17.

Figure 6:
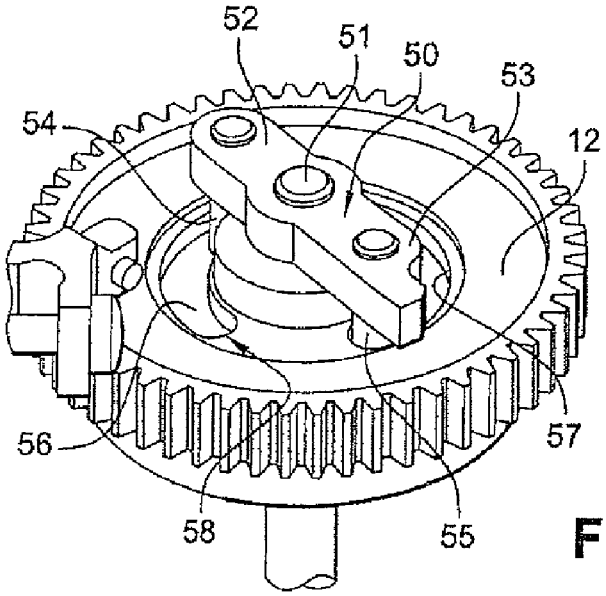
FIG. 6 is a partial perspective view of the drivetrain of a three-way valve according to an alternative form of the mechanism for temporally phase shifting the closing of the air flap in relation to the opening of the gas flap.
Figure 7:
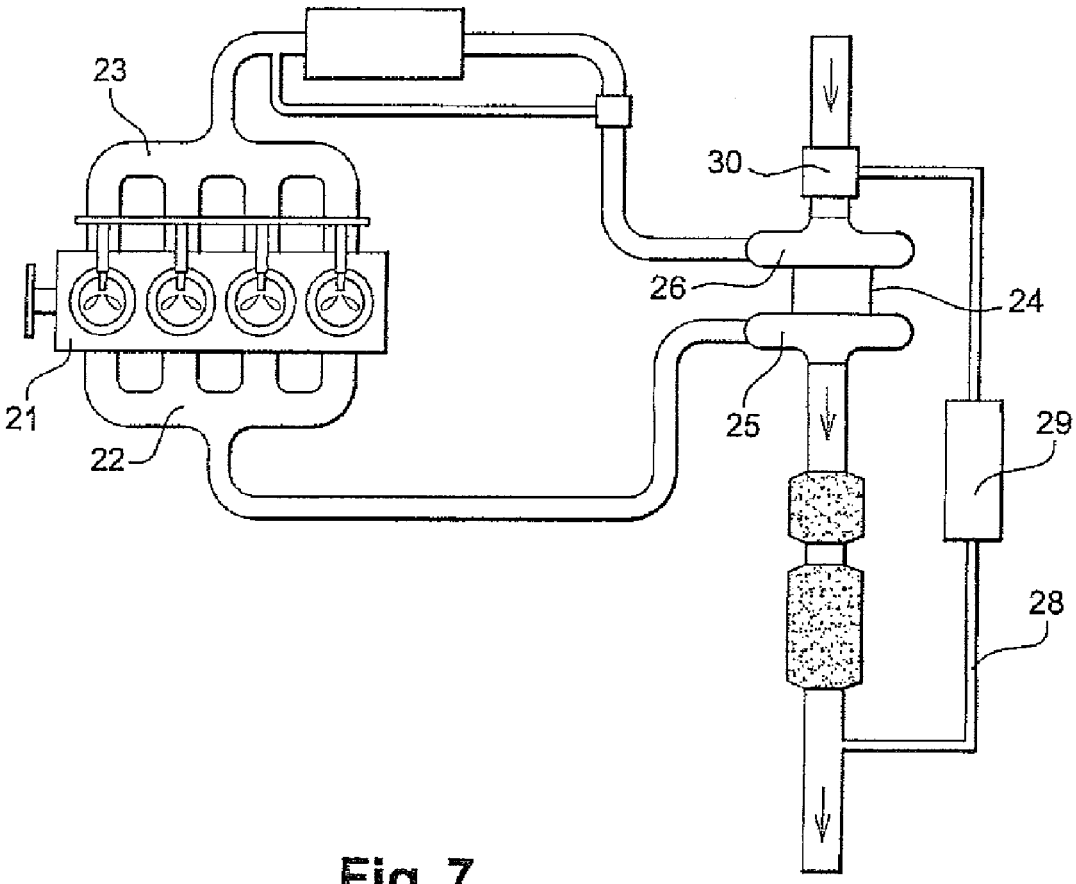
FIG. 7 is a simplified depiction of the EGR loop used according to the invention.

A variant embodiment of the phase shifting mechanism is depicted in FIG. 6. In this variant, a crossmember 50 with two radial arms 52, 53 is mounted on the shaft 51 of the flap 5. Each of the arms 52, 53 has at its end a driving pin 54, 55 running substantially parallel to the shaft 51.

Two circular slots 56, 57 for driving the pins 54, 55 in a circular translational movement are formed in the annulus gear 12. The pins 54, 55 respectively run in these two slots 56, 57.

As long as the pins 54, 55 are not resting against one of the end walls 58 of the slots 56, 67, the shaft 51 and the air flap 5 cannot be rotated. As soon as the pins 54, 55 come into abutment against the respective end walls of the two slots 56, 57, the annulus gear 12 drives them along with it, causing the flap 5 to rotate.

To ensure correct operation of the three-way valve, it is necessary for the angle subtended by the slots to be less than 180°. If $\alpha_g$ is the angle through which the gas flap 6 rotates, $\alpha_a$, is the angle through which the air flap 5 rotates, the equation (1) must be satisfied $$(\alpha_g - \alpha_a) \times \frac{\alpha_g}{\alpha_a} < 180 \tag{1}$$

Figure 2A:
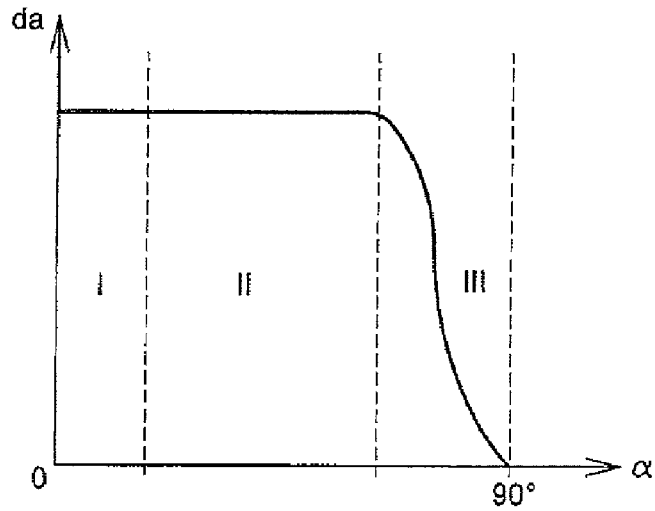
Figure 2B:
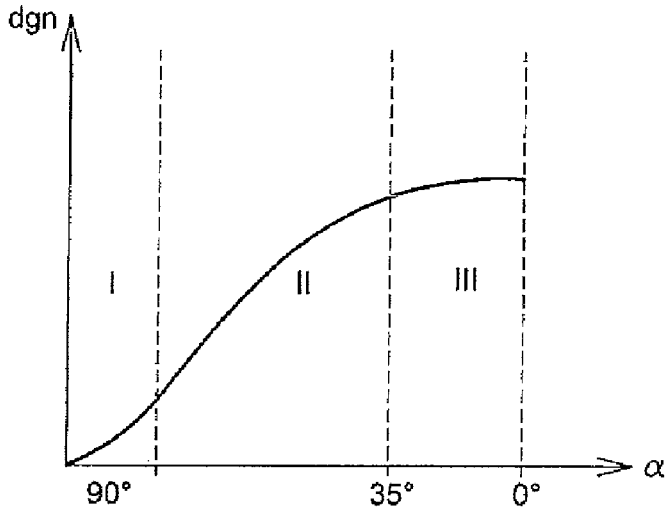
Figure 2C:
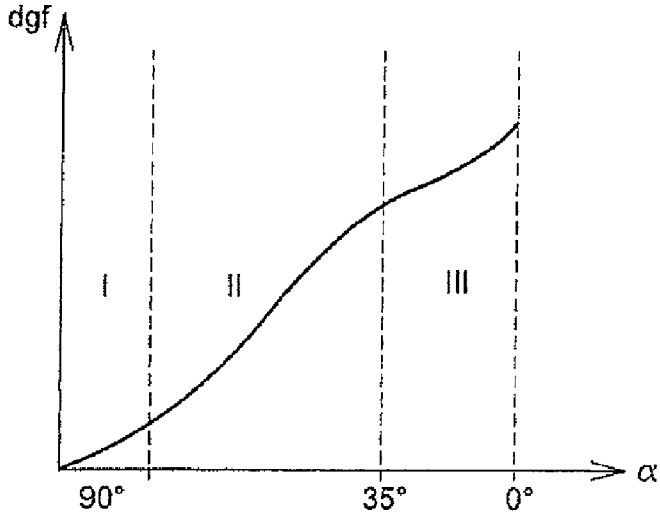

If we consider $\alpha_g$=90° (FIG. 2*b*), then the angle $\alpha_a$ through which the air flap 5 rotates must satisfy equation (2)

$$\alpha_a > 30° \tag{2}$$

The gearing ratio $$R = \frac{\alpha_g}{\alpha_a}$$

must then satisfy equation (3)

$$R < 3 \tag{3}$$

In the example mentioned hereinabove, the parameters considered were $$R = \frac{15.67}{6.67} = 2.35$$

The circular slots 56, 57 are formed in the annulus gear 12 with respect to the toothed sector of the annulus gear 12 giving due consideration to the size of the angle through which the gas flap 6 rotates before the air flap 5 begins to rotate.

The valve that has just been described is notable through the singularity of its control, being controlled solely by the DC motor 7, making it more cost-effective and compact.

This control can be achieved using an H-bridge, well known to those skilled in the art, with two pairs of switches in series and the component that is to be controlled—in this instance the motor—connected to the two mid-points of the two pairs of switches, the two pairs being connected between a battery voltage and ground.

The invention claimed is:

1. A method of operating a motor vehicle internal combustion engine EGR loop, comprising the engine (21), a combustion gas exhaust manifold (22), a turbocharger (24), a turbine (25), the exhaust gas recirculation (EGR) loop (28) with a cooler (29) and a low-pressure three-way valve (30), as an EGR valve (1), positioned upstream of the turbocharger compressor (26) and connected thereto by an outlet and comprising two inlets for receiving fresh air and the cooled exhaust gases in a mixture the pressure of which is increased in the compressor, and an engine intake manifold (23) for receiving the exhaust gases and the air from the compressor (26), characterized in that:

with the fresh air flow rate in a fresh air inlet path (2) of the EGR valve (1) set at a maximum, the path (3) for the EGR gases in the EGR valve is progressively opened, and before the EGR gas flow rate in the EGR valve increases any further, the fresh air inlet path (2) is progressively closed in order to continue to cause the EGR gas flow rate to increase on an increasing monotonous curve.

2. The method of operating as claimed in claim 1, further comprising a three-way valve (1) that has two flaps (5, 6) for the two paths, fresh air (2) and EGR gas (3), respectively.

3. The method of operating as claimed in claim 2, in which, with the EGR gas flow rate in the EGR inlet path (3) of the EGR valve (1) beginning to drop after a rotation of the corresponding flap (6) through 55, it is from this angular position of the EGR gas flap (6) that the fresh air intake flap (5) begins to be turned in order to close the fresh air inlet path (2) in the EGR valve, this continuing until the fresh air intake flap (5) has been turned through 90° and the air inlet path (2) has been completely shut off.

4. The method of operating as claimed in claim 3, characterized in that the fresh air intake flap (5) is rotated until it has been turned through 90°.

5. The method of operating as claimed in claim 4, characterized in that the fresh air intake flap (5) is rotated until the fresh air inlet path (2) is completely shut off.

6. The method of operating as claimed in claim 4, characterized in that the fresh air intake flap (5) is rotated until the air inlet path (2) is partially shut off.

7. The method of operating as claimed in claim 3, characterized in that the fresh air intake flap (5) is rotated until the fresh air inlet path (2) is completely shut off.

8. The method of operating as claimed in claim 3, characterized in that the fresh air intake flap (5) is rotated until the air inlet path (2) is partially shut off.

* * * * *